US009348242B2

(12) United States Patent
Tanaka

(10) Patent No.: US 9,348,242 B2
(45) Date of Patent: May 24, 2016

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventor: Masato Tanaka, Tagata-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 31 days.

(21) Appl. No.: 14/097,216

(22) Filed: Dec. 4, 2013

(65) Prior Publication Data

US 2014/0170541 A1 Jun. 19, 2014

(30) Foreign Application Priority Data

Dec. 14, 2012 (JP) ..... 2012-273721

(51) Int. Cl.
*G03G 5/047* (2006.01)
*G03G 5/06* (2006.01)

(52) U.S. Cl.
CPC ..... *G03G 5/0609* (2013.01); *G03G 5/047* (2013.01); *G03G 5/0612* (2013.01); *G03G 5/0614* (2013.01); *G03G 5/0696* (2013.01)

(58) Field of Classification Search
CPC . G03G 5/0609; G03G 5/0612; G03G 5/0614; G03G 5/0696
USPC ..... 430/59.4, 59.2
See application file for complete search history.

(56) References Cited

U.S. PATENT DOCUMENTS

| | | | | |
|---|---|---|---|---|
| 5,393,627 | A * | 2/1995 | Nakamura et al. | 430/58.5 |
| 6,335,132 | B1 * | 1/2002 | Tanaka et al. | 430/59.3 |
| 7,333,752 | B2 | 2/2008 | Kawahara et al. | |
| 8,415,078 | B2 | 4/2013 | Tanaka et al. | |
| 8,518,615 | B2 | 8/2013 | Tanaka | |
| 8,841,052 | B2 * | 9/2014 | Watariguchi et al. | 430/60 |
| 2011/0200743 | A1 * | 8/2011 | Kawai et al. | 427/162 |
| 2012/0003576 | A1 * | 1/2012 | Tanaka et al. | 430/56 |
| 2012/0115076 | A1 * | 5/2012 | Kitamura et al. | 430/56 |
| 2013/0121727 | A1 * | 5/2013 | Kaku et al. | 399/111 |
| 2015/0093693 | A1 | 4/2015 | Watariguchi et al. | |

FOREIGN PATENT DOCUMENTS

| | | | |
|---|---|---|---|
| JP | 2001-66804 | A | 3/2001 |
| JP | 2002-229228 | A | 8/2002 |
| JP | 2004-125907 | A | 4/2004 |
| JP | 2005-84350 | A | 3/2005 |
| JP | 2011-94101 | A | 5/2011 |
| JP | 2012-32781 | A | 2/2012 |

OTHER PUBLICATIONS

U.S. Appl. No. 14/101,292, filed Dec. 9, 2013, Applicants: Tanaka, et al.

* cited by examiner

*Primary Examiner* — Christopher Rodee
(74) *Attorney, Agent, or Firm* — Fitzpatrick, Cella, Harper and Scinto

(57) ABSTRACT

Provided is an electrophotographic photosensitive member including a charge-generating layer that includes: an amine compound represented by the formula (1) and a gallium phthalocyanine crystal, or a gallium phthalocyanine crystal containing the amine compound represented by the formula (1); and an arene compound, in which the arene compound includes at least one compound selected from the group consisting of a compound represented by the formula (2) and a compound represented by the formula (3).

Formula (1)
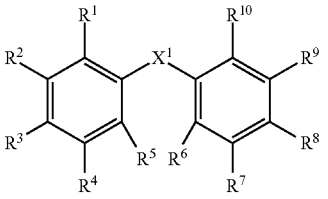
Formula (2)
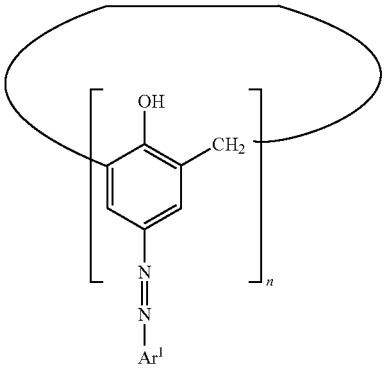
-continued
Formula (3)
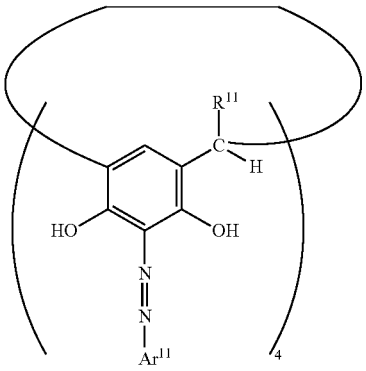
15 Claims, 2 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus each including the electrophotographic photosensitive member.

2. Description of the Related Art

An oscillation wavelength of semiconductor laser, which has been frequently used as an image exposing device of an electrophotographic photosensitive member is, at present, a long wavelength such as 650 to 820 nm. Accordingly, development of an electrophotographic photosensitive member having high sensitivity to light having such a long wavelength has been advanced.

A phthalocyanine pigment is effective as a charge-generating substance having high sensitivity to light having a wavelength in such a long-wavelength region. In particular, oxytitanium phthalocyanine and a gallium phthalocyanine have excellent sensitivity characteristics, and various crystal forms thereof have been reported heretofore.

An electrophotographic photosensitive member using the gallium phthalocyanine pigment has an excellent sensitivity characteristic. However, the electrophotographic photosensitive member has a drawback in that dispersibility of pigment particles is poor. Consequently, it has been difficult to obtain a coating material for a charge-generating layer excellent in coatability by using such pigment.

As a problem arising when the coatability of the coating material for a charge-generating layer is poor, there can be specifically given a phenomenon in which aggregation of the pigment particles is liable to occur at the time of coating, consequently generating a spot (blue spot) or causing coating unevenness in the charge-generating layer. Particularly when a ratio of the charge-generating substance contained in the charge-generating layer is high, an absolute amount of a resin contained in the charge-generating layer reduces, and hence such problem presents in an additionally remarkable manner. The blue spot in the charge-generating layer causes a black spot or fogging particularly in an output image, while the coating unevenness in the charge-generating layer causes unevenness in image density particularly in a halftone portion. Thus, the blue spot and the coating unevenness cause image quality deterioration.

Japanese Patent Application Laid-Open No. 2005-84350 discloses that a combination of the gallium phthalocyanine and a specific polyvinyl alcohol resin is excellent in coatability and stability of the coating material.

In addition, Japanese Patent Application Laid-Open No. 2001-66804 and Japanese Patent Application Laid-Open No. 2002-229228 disclose that an azotized calixarene compound or a resorcinarene compound is used in the photosensitive layer. Although Japanese Patent Application Laid-Open No. 2001-66804 and Japanese Patent Application Laid-Open No. 2002-229228 disclose that the use of the arene compound alleviates a ghost phenomenon, there are no descriptions of the dispersibility or the coatability thereof.

As described above, various improvements have been attempted for an electrophotographic photosensitive member.

However, a high-quality output image free of any black spot or fogging and free of any density unevenness has been desired in association with an additional improvement in image quality in recent years.

SUMMARY OF THE INVENTION

In view of the foregoing, the present invention is directed to providing an electrophotographic photosensitive member capable of outputting a high-quality image free of any black spot or fogging and free of any density unevenness without coating unevenness of the charge-generating layer.

Further, the present invention is directed to providing an electrophotographic apparatus and a process cartridge each including the electrophotographic photosensitive member.

According to one aspect of the present invention, there is provided an electrophotographic photosensitive member, including: a support; a charge-generating layer; and a charge-transporting layer, the charge-generating layer and the charge-transporting layer being formed on the support, in which the charge-generating layer includes: a gallium phthalocyanine crystal; an amine compound represented by the following formula (1) at 0.05 mass % or more and 20 mass % or less with respect to the gallium phthalocyanine crystal; and an arene compound at 0.3 mass % or more and 5 mass % or less with respect to the gallium phthalocyanine crystal, the arene compound including at least one compound selected from the group consisting of a compound represented by the following formula (2) and a compound represented by the following formula (3):

Formula (1)

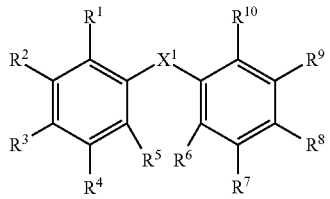

in the formula (1), $R^1$ to $R^{10}$ each independently represent a hydrogen atom, a halogen atom, an aryloxycarbonyl group, a substituted or unsubstituted acyl group, a substituted or unsubstituted alkyl group, a substituted or unsubstituted alkoxy group, a substituted or unsubstituted aryloxy group, an amino group having a substituent, or a substituted or unsubstituted cyclic amino group, provided that at least one of $R^1$ to $R^{10}$ represents an amino group substituted with a substituted or unsubstituted aryl group, an amino group substituted with a substituted or unsubstituted alkyl group, or a substituted or unsubstituted cyclic amino group, and $X^1$ represents a carbonyl group or a dicarbonyl group;

Formula (2)

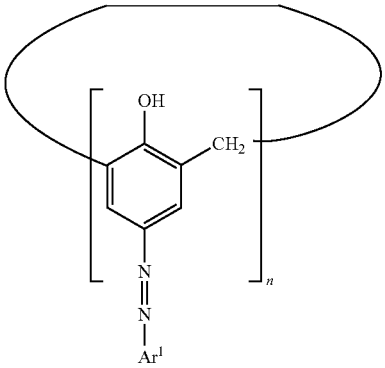

in the formula (2), n represents an integer selected from 4 to 8, and n pieces of $Ar^1$ are identical to each other, and represent an aromatic hydrocarbon ring group that may have a substituent, a hetero ring group that may have a substituent, or a group formed by a combination of multiple aromatic hydrocarbon ring groups or multiple hetero ring groups; and Formula (3)

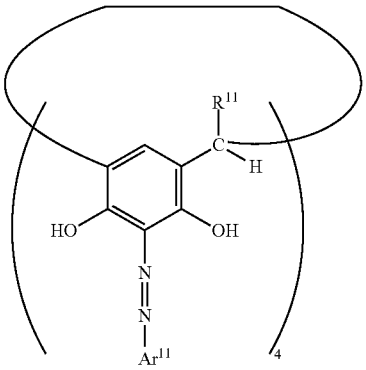

in the formula (3), four pieces of $R^{11}$ are identical to each other, and represent a hydrogen atom or an alkyl group that may have a substituent, and four pieces of $Ar^{11}$ are identical to each other, and represent an aromatic hydrocarbon ring group that may have a substituent, a hetero ring group that may have a substituent, or a group formed by a combination of multiple aromatic hydrocarbon ring groups or multiple hetero ring groups.

According to another aspect of the present invention, there is provided a process cartridge detachably mountable to a main body of an electrophotographic apparatus, in which the process cartridge integrally supports: the above-described electrophotographic photosensitive member; and at least one device selected from the group consisting of a charging device for charging a surface of the electrophotographic photosensitive member, a developing device for developing an electrostatic latent image formed on the surface of the electrophotographic photosensitive member with toner to form a toner image, and a cleaning device for removing the toner on the surface of the electrophotographic photosensitive member after transfer of the toner image onto a transfer material.

According to further aspect of the present invention, there is provided an electrophotographic apparatus including: the above-described electrophotographic photosensitive member; a charging device for charging a surface of the electrophotographic photosensitive member; an image exposing device for irradiating the charged surface of the electrophotographic photosensitive member with image exposure light to form an electrostatic latent image; a developing device for developing the electrostatic latent image formed on the surface of the electrophotographic photosensitive member with toner to form a toner image; and a transferring device for transferring the toner image formed on the surface of the electrophotographic photosensitive member onto a transfer material.

According to the present invention, there are provide the electrophotographic photosensitive member capable of outputting a high-quality image free of any black spot or fogging and free of any density unevenness without coating unevenness of the charge-generating layer, and the process cartridge and the electrophotographic apparatus each including the above-described electrophotographic photosensitive member.

Further features of the present invention will become apparent from the following description of exemplary embodiments with reference to the attached drawings.

DESCRIPTION OF THE EMBODIMENTS

Figure 1:
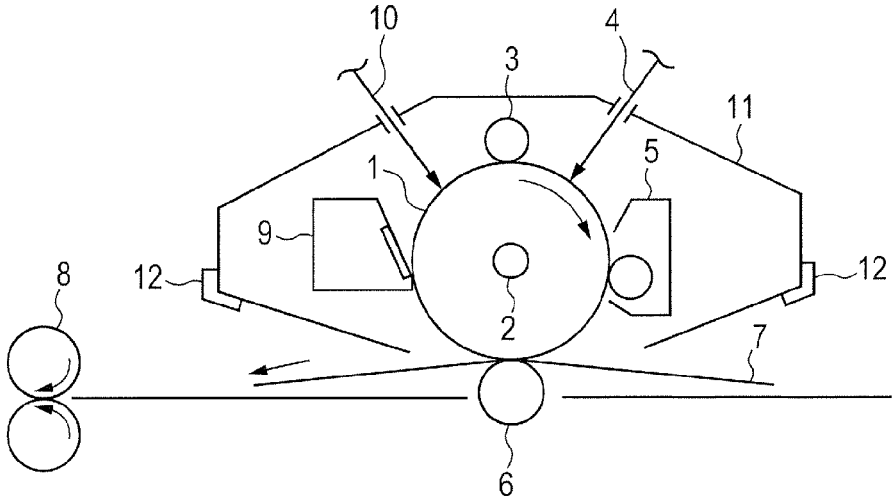
FIG. 1 is a view illustrating an example of a schematic configuration of an electrophotographic apparatus including a process cartridge having an electrophotographic photosensitive member.

As described above, an electrophotographic photosensitive member of the present invention includes: a support; a charge-generating layer; and a charge-transporting layer, the charge-generating layer and the charge-transporting layer being formed on the support, in which the charge-generating layer includes: a gallium phthalocyanine crystal; an amine compound represented by the following formula (1) at 0.05 mass % or more and 20 mass % or less with respect to the gallium phthalocyanine crystal; and an arene compound at 0.3 mass % or more and 5 mass % or less with respect to the gallium phthalocyanine crystal, the arene compound including at least one compound selected from the group consisting of a compound represented by the following formula (2) and a compound represented by the following formula (3):

Formula (1)

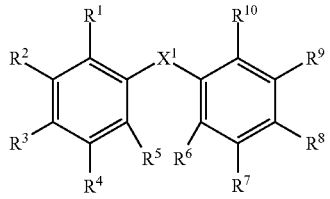

in the formula (1), $R^1$ to $R^{10}$ each independently represent a hydrogen atom, a halogen atom, an aryloxycarbonyl group, a substituted or unsubstituted acyl group, a substituted or unsubstituted alkyl group, a substituted or unsubstituted alkoxy group, a substituted or unsubstituted aryloxy group, an amino group having a substituent, or a substituted or unsubstituted cyclic amino group, provided that at least one of $R^1$ to $R^{10}$ represents an amino group substituted with a substituted or unsubstituted aryl group, an amino group substituted with a substituted or unsubstituted alkyl group, or a substituted or unsubstituted cyclic amino group, and $X^1$ represents a carbonyl group or a dicarbonyl group;

Formula (2)

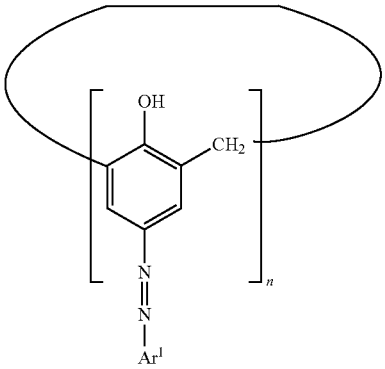

in the formula (2), n represents an integer selected from 4 to 8, and n pieces of $Ar^1$ are identical to each other, and represent an aromatic hydrocarbon ring group that may have a substituent, a hetero ring group that may have a substituent, or a group formed by a combination of multiple aromatic hydrocarbon ring groups or multiple hetero ring groups; and Formula (3)

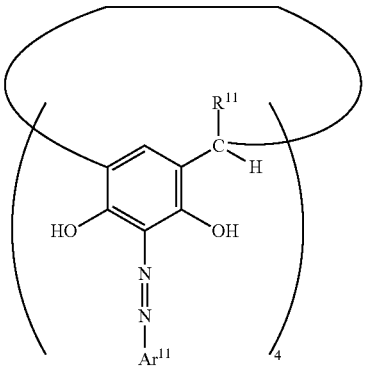

in the formula (3), four pieces of $R^{11}$ are identical to each other, and represent a hydrogen atom or an alkyl group that may have a substituent, and four pieces of $Ar^{11}$ are identical to each other, and represent an aromatic hydrocarbon ring group that may have a substituent, a hetero ring group that may have a substituent, or a group formed by a combination of multiple aromatic hydrocarbon ring groups or multiple hetero ring groups.

Further, at least one of $R^1$ to $R^{10}$ in the formula (1) preferably represents an amino group substituted with a substituted or unsubstituted alkyl group. Of such groups, an alkyl group substituted with an alkoxy group, an alkyl group substituted with an aryl group, or an unsubstituted alkyl group is more preferred.

Further, at least one of $R^1$ to $R^{10}$ in the formula (1) preferably represents a dialkylamino group. Of such groups, a dimethylamino group or a diethylamino group is more preferred. A particularly preferred amine compound is 4,4'-bis(diethylamino)benzophenone.

In addition, at least one of $R^1$ to $R^{10}$ in the formula (1) preferably represents a substituted or unsubstituted cyclic amino group. In this case, the cyclic amino group is preferably a three- to eight-membered cyclic amino group, and at least one of carbon atoms constituting the rings may be substituted with, for example, an oxygen or nitrogen atom. Of those, a morpholino group or a 1-piperidino group as a six-membered cyclic amino group is more preferred.

In addition, examples of the substituent which the substituted or unsubstituted acyl group, the substituted or unsubstituted alkyl group, the substituted or unsubstituted alkoxy group, the substituted or unsubstituted aryloxy group, the substituted or unsubstituted amino group, the substituted or unsubstituted aryl group, and the substituted or unsubstituted cyclic amino group in the formula (1) may each have include: alkyl groups such as a methyl group, an ethyl group, a propyl group, and a butyl group; alkoxy groups such as a methoxy group and an ethoxy group; dialkylamino groups such as a dimethylamino group and a diethylamino group; alkoxycarbonyl groups such as a methoxycarbonyl group and an ethoxycarbonyl group; aryl groups such as a phenyl group, a naphthyl group, and a biphenylyl group; halogen atoms such as a fluorine atom, a chlorine atom, and a bromine atom; a nitro group; a cyano group; and a halomethyl group. Of those, an aryl group or an alkoxy group is a preferred substituent.

Hereinafter, a preferred specific example (Exemplified Compound) of an amine compound represented by the formula (1) is described. However, the present invention is not limited thereto.

Exemplified Compound (1)

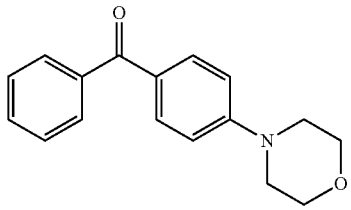

Exemplified Compound (2)

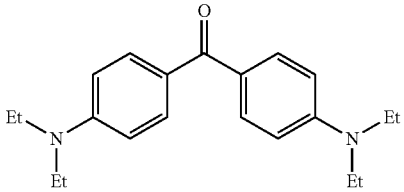

Exemplified Compound (3)

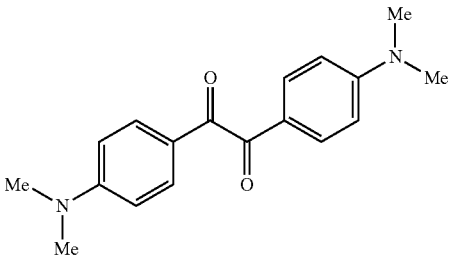

-continued
Exemplified Compound (4)
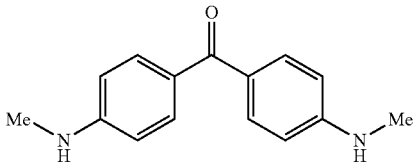
Exemplified Compound (5)
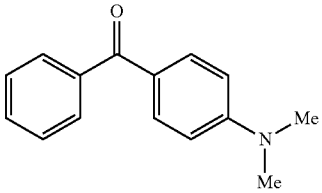
Exemplified Compound (6)
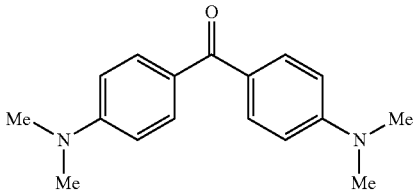
Exemplified Compound (7)
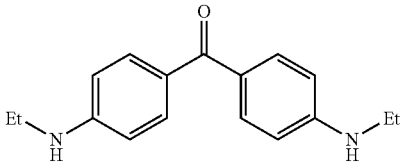
Exemplified Compound (8)
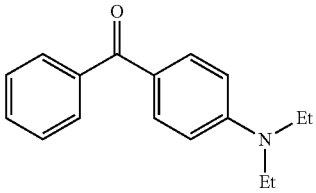
Exemplified Compound (9)
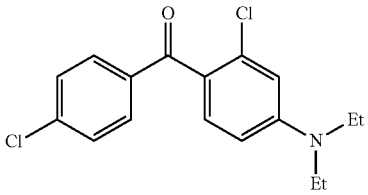
Exemplified Compound (10)
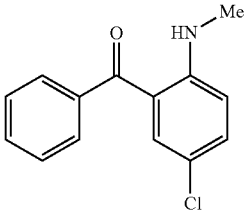
-continued
Exemplified Compound (11)
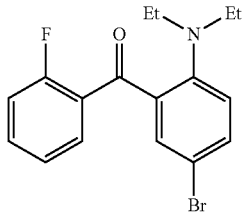
Exemplified Compound (12)
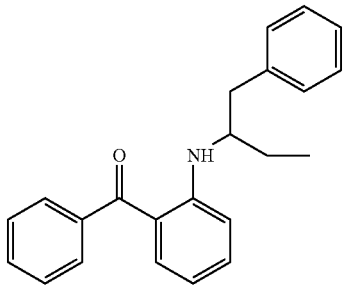
Exemplified Compound (13)
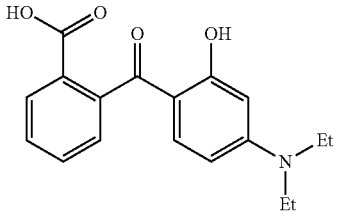
Exemplified Compound (14)
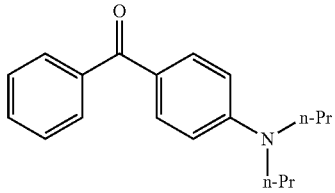
Exemplified Compound (15)
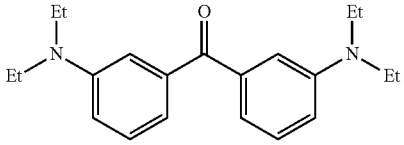
Exemplified Compound (16)
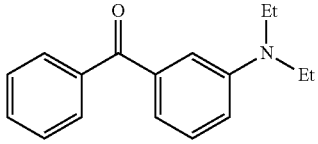
Exemplified Compound (17)
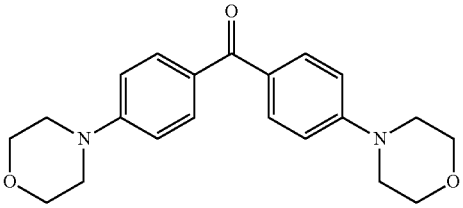

-continued

Exemplified Compound (18)

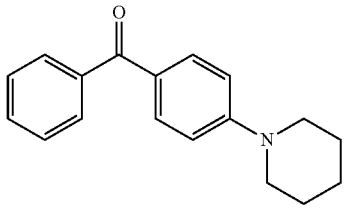

Exemplified Compound (19)

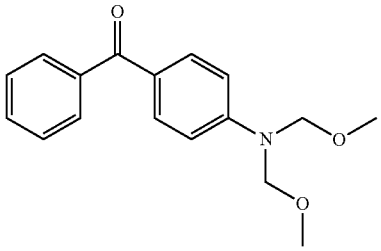

Exemplified Compound (20)

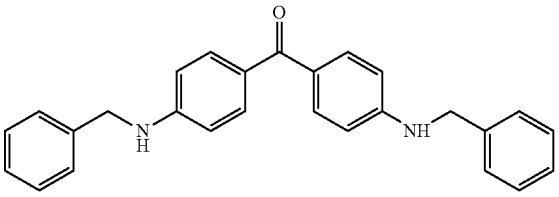

Exemplified Compound (21)

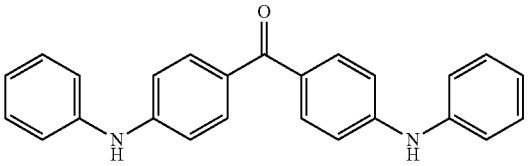

Exemplified Compound (22)

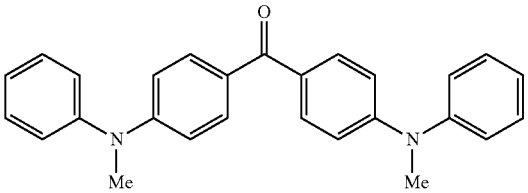

Exemplified Compound (23)

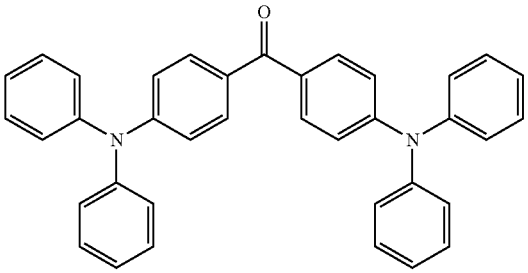

-continued

Exemplified Compound (24)

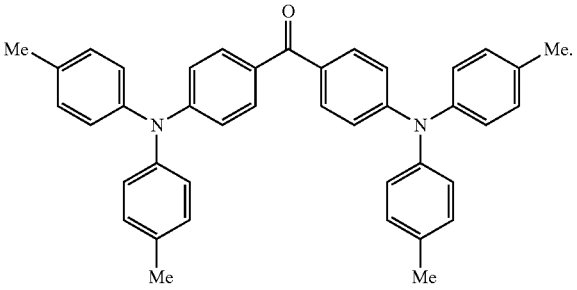

In the exemplified compounds, Me represents a methyl group, Et represents an ethyl group, and n-Pr represents a propyl group (n-propyl group).

$Ar^1$ in the formula (2) is preferably a phenyl group having at least one group selected from the group consisting of a cyano group, a nitro group, and a halogen atom. Of those, a phenyl group having a cyano group or a nitro group at the meta-position thereof is more preferred from the viewpoint of dispersion stability.

In addition, examples of the aromatic hydrocarbon ring group or the hetero ring group in the formula (2) include: hydrocarbon-based aromatic ring groups such as benzene, naphthalene, fluorene, phenanthrene, anthracene, fluoranthene, and pyrene; and hetero ring groups such as furan, thiophene, pyridine, indole, benzothiazole, carbazole, benzocarbazole, acridone, dibenzothiophene, benzoxazole, benzotriazole, oxathiazole, thiazole, phenazine, cinnoline, and benzocinnoline. Further, examples of the group formed by combining the aromatic hydrocarbon ring groups or the hetero ring groups directly or through an aromatic group or non-aromatic group (sometimes referred to as group formed by a combination of a plurality of aromatic hydrocarbon ring groups or a plurality of hetero ring groups) include triphenylamine, diphenylamine, N-methyldiphenylamine, biphenyl, terphenyl, binaphthyl, fluorenone, phenanthrenequinone, anthraquinone, benzanthrone, diphenyloxazole, phenylbenzoxazole, diphenylmethane, diphenyl sulfone, diphenyl ether, benzophenone, stilbene, distyrylbenzene, tetraphenyl-p-phenylenediamine, and tetraphenylbenzidine.

Examples of the substituent that each of the groups may have include: alkyl groups such as methyl, ethyl, propyl, and butyl; alkoxy groups such as methoxy and ethoxy; dialkylamino groups such as dimethylamino and diethylamino; alkoxycarbonyl groups such as methoxycarbonyl and ethoxycarbonyl; halogen atoms such as a fluorine atom, a chlorine atom, and a bromine atom; a hydroxy group; a nitro group; a cyano group; an acetyl group; and a halomethyl group.

Hereinafter, a preferred specific example (Exemplified Compound) of a compound represented by the formula (2) is described. However, the present invention is not limited thereto.

Exemplified Compound (2-1)
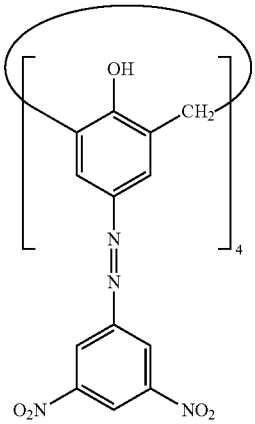
Exemplified Compound (2-2)
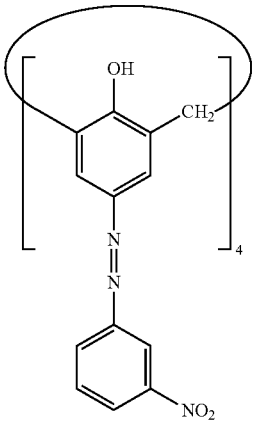
Exemplified Compound (2-3)
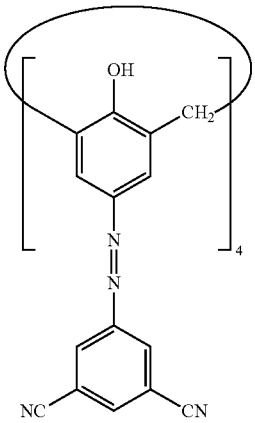
-continued
Exemplified Compound (2-4)
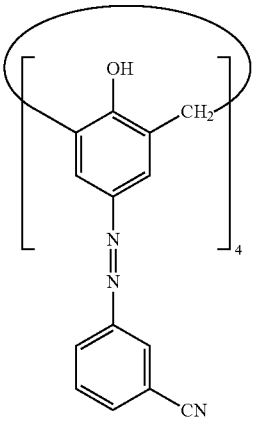
Exemplified Compound (2-5)
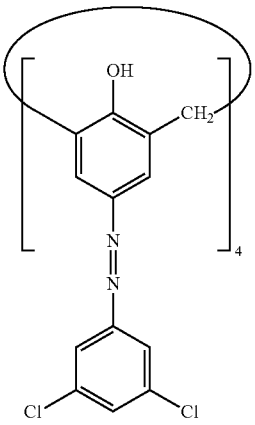
Exemplified Compound (2-6)
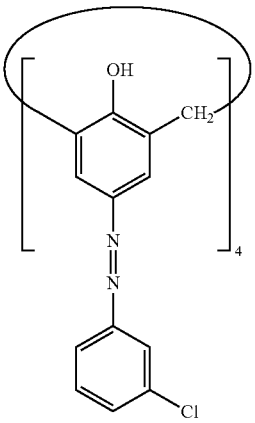

-continued
Exemplified Compound (2-7)
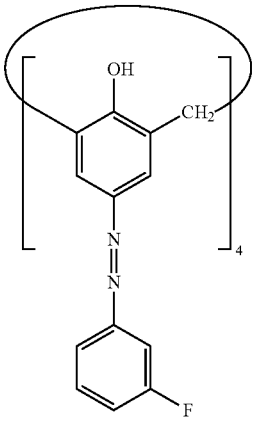
Exemplified Compound (2-8)
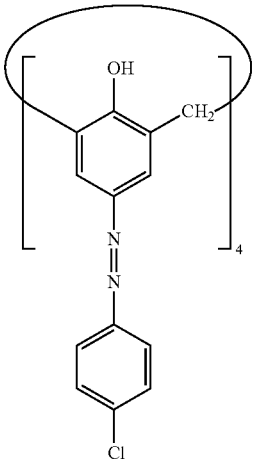
Exemplified Compound (2-9)
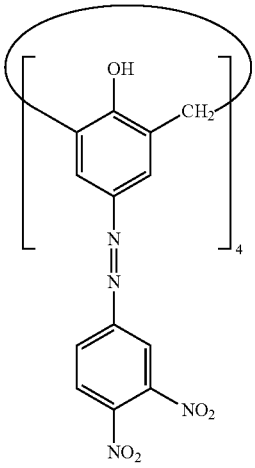
-continued
Exemplified Compound (2-10)
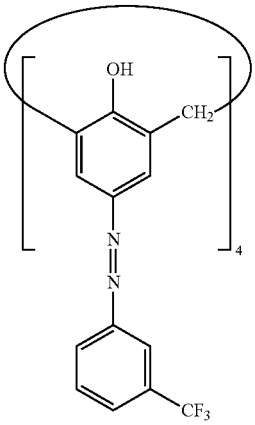
Exemplified Compound (2-11)
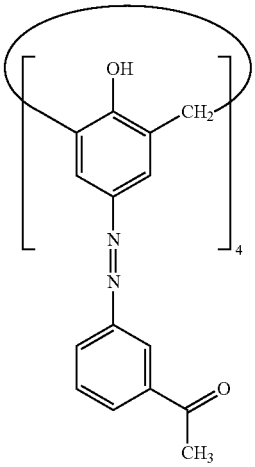
Exemplified Compound (2-12)
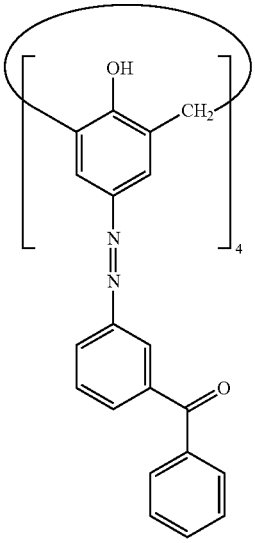

-continued
Exemplified Compound (2-13)
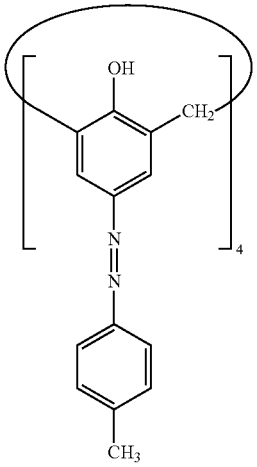
Exemplified Compound (2-14)
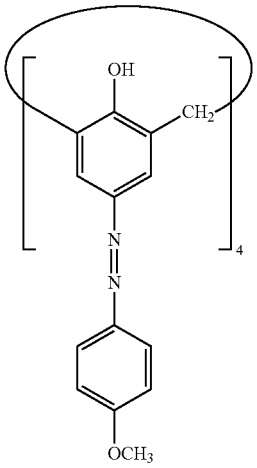
Exemplified Compound (2-15)
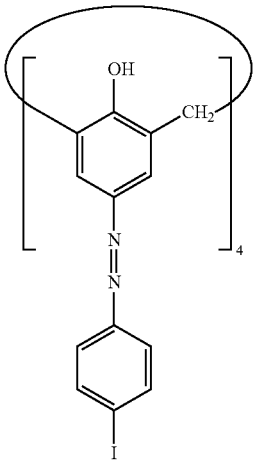
-continued
Exemplified Compound (2-16)
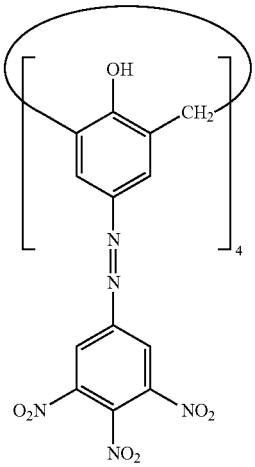
Exemplified Compound (2-17)
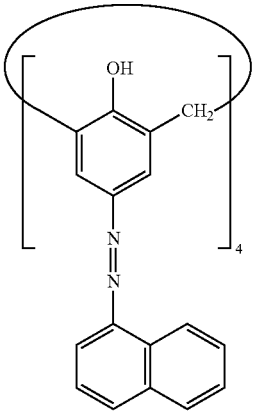
Exemplifiede Compound (2-18)
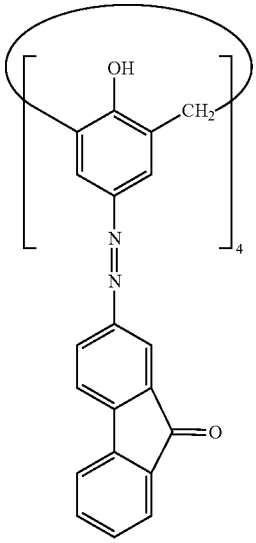

-continued

Exemplified Compound (2-19)

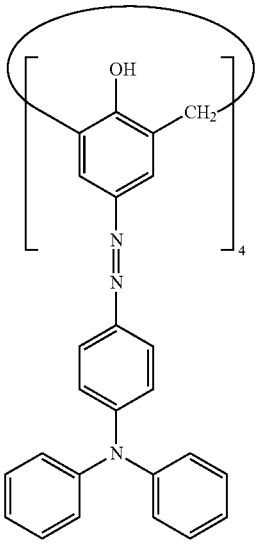

Exemplified Compound (2-20)

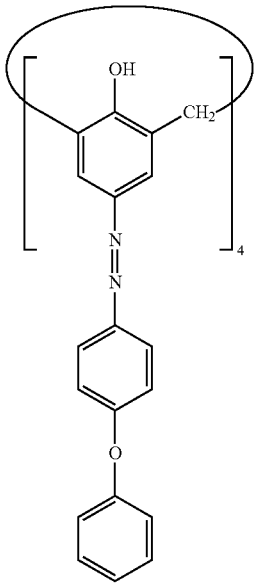

Exemplified Compound (2-21)

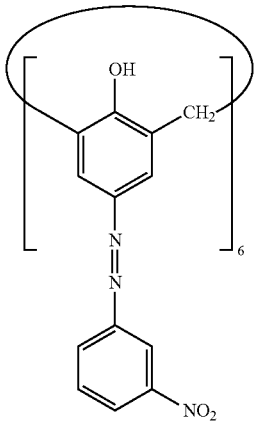

-continued

Exemplified Compound (2-22)

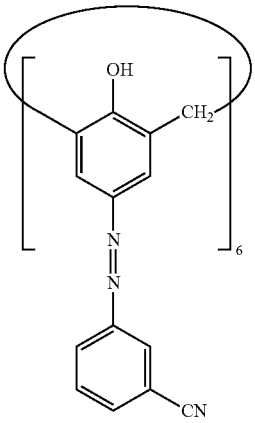

Exemplified Compound (2-23)

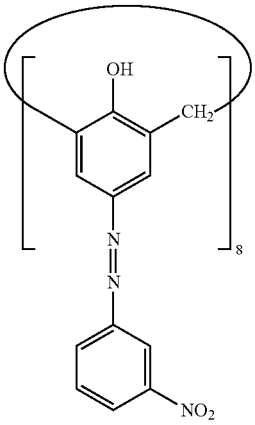

Exemplified Compound (2-24)

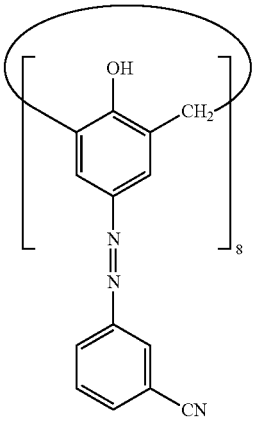

$Ar^{11}$ in the formula (3) is preferably a phenyl group having at least one group selected from the group consisting of a cyano group, a nitro group, and a halogen atom. Of those, a phenyl group having a cyano group or a nitro group at the meta-position thereof is more preferred from the viewpoint of dispersion stability.

In addition, examples of the aromatic hydrocarbon ring group or the hetero ring group in the formula (3) include: hydrocarbon-based aromatic ring groups such as benzene, naphthalene, fluorene, phenanthrene, anthracene, fluoranthene, and pyrene; and hetero ring groups such as furan, thiophene, pyridine, indole, benzothiazole, carbazole, benzocarbazole, acridone, dibenzothiophene, benzoxazole, benzotriazole, oxathiazole, thiazole, phenazine, cinnoline, and benzocinnoline. Further, examples of the group formed by combining the aromatic hydrocarbon ring groups or the hetero ring groups directly or through an aromatic group or non-aromatic group (sometimes referred to as group formed by a combination of a plurality of aromatic hydrocarbon ring groups or a plurality of hetero ring groups) include triphenylamine, diphenylamine, N-methyldiphenylamine, biphenyl, terphenyl, binaphthyl, fluorenone, phenanthrenequinone, anthraquinone, benzanthrone, diphenyloxazole, phenylbenzoxazole, diphenylmethane, diphenyl sulfone, diphenyl ether, benzophenone, stilbene, distyrylbenzene, tetraphenyl-p-phenylenediamine, and tetraphenylbenzidine.

In addition, examples of the alkyl group represented by $R^{11}$ in the formula (3) include a methyl group, an ethyl group, a propyl group, a butyl group, a hexyl group, an undecyl group, and a tridecyl group.

In addition, examples of the substituent that each of the groups may have include: alkyl groups such as methyl, ethyl, propyl, and butyl; alkoxy groups such as methoxy and ethoxy; dialkylamino groups such as dimethylamino and diethylamino; alkoxycarbonyl groups such as methoxycarbonyl and ethoxycarbonyl; halogen atoms such as a fluorine atom, a chlorine atom, and a bromine atom; a hydroxy group; a nitro group; a cyano group; an acetyl group; and a halomethyl group.

Hereinafter, a preferred specific example (Exemplified Compound) of a compound represented by the formula (3) is described. However, the present invention is not limited thereto.

TABLE 1

| | $R^{11}$ | $Ar^{11}$ |
|---|---|---|
| Exemplified Compound (3-1) | $—CH_3$ | 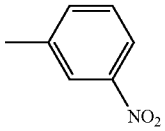 |
| Exemplified Compound (3-2) | $—CH_2CH_3$ | 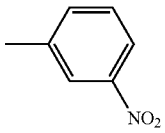 |
| Exemplified Compound (3-3) | $—(CH_2)_5CH_3$ | 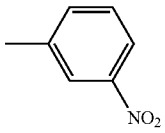 |
| Exemplified Compound (3-4) | $—(CH_2)_{10}CH_3$ | 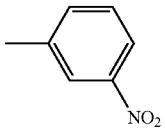 |
| Exemplified Compound (3-5) | $—CH_3$ | 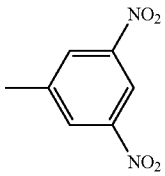 |

TABLE 1-continued

| | $R^{11}$ | $Ar^{11}$ |
|---|---|---|
| Exemplified Compound (3-6) | $—CH_2CH_3$ | 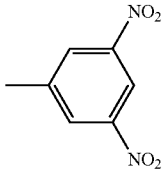 |
| Exemplified Compound (3-7) | $—(CH_2)_5CH_3$ | 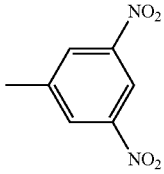 |
| Exemplified Compound (3-8) | $—(CH_2)_{10}CH_3$ | 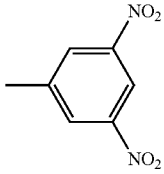 |
| Exemplified Compound (3-9) | $—CH_2CH_3$ | 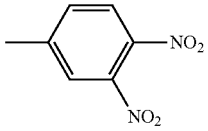 |
| Exemplified Compound (3-10) | $—(CH_2)_{10}CH_3$ | 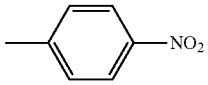 |
| Exemplified Compound (3-11) | $—CH_3$ | 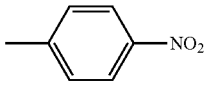 |
| Exemplified Compound (3-12) | $—CH_3$ | 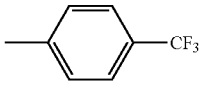 |
| Exemplified Compound (3-13) | $—CH_2CH_3$ | 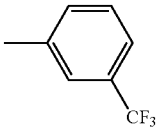 |
| Exemplified Compound (3-14) | $—(CH_2)_5CH_3$ | 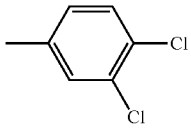 |
| Exemplified Compound (3-15) | $—(CH_2)_{10}CH_3$ | 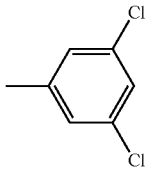 |

TABLE 2

| | $R^{11}$ | $Ar^{11}$ |
|---|---|---|
| Exemplified Compound (3-16) | $—CH_3$ | 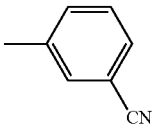 |
| Exemplified Compound (3-17) | $—CH_2CH_3$ | 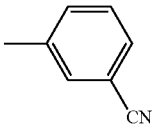 |
| Exemplified Compound (3-18) | $—(CH_2)_5CH_3$ | 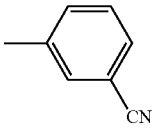 |
| Exemplified Compound (3-19) | $—(CH_2)_{10}CH_3$ | 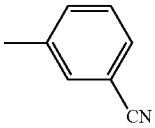 |
| Exemplified Compound (3-20) | $—CH_3$ | 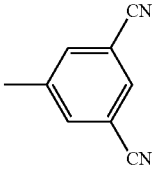 |
| Exemplified Compound (3-21) | $—CH_2CH_3$ | 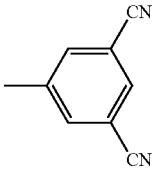 |
| Exemplified Compound (3-22) | $—(CH_2)_5CH_3$ | 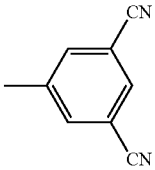 |
| Exemplified Compound (3-23) | $—(CH_2)_{10}CH_3$ | 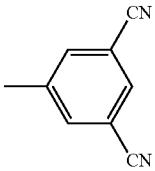 |
| Exemplified Compound (3-24) | $—CH_2CH_3$ | 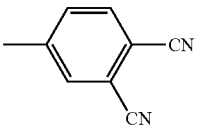 |
| Exemplified Compound (3-25) | $—(CH_2)_{10}CH_3$ | 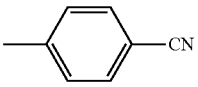 |

TABLE 2-continued

| | $R^{11}$ | $Ar^{11}$ |
|---|---|---|
| Exemplified Compound (3-26) | $—CH_3$ | 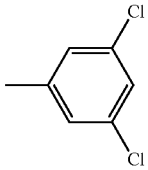 |
| Exemplified Compound (3-27) | $—CH_3$ | 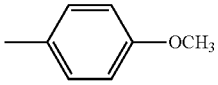 |
| Exemplified Compound (3-28) | $—CH_2CH_3$ | 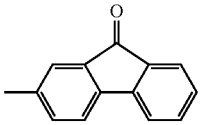 |
| Exemplified Compound (3-29) | $—(CH_2)_5CH_3$ | 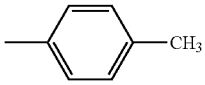 |
| Exemplified Compound (3-30) | $—(CH_2)_{10}CH_3$ | 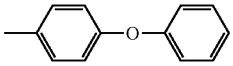 |

Examples of the gallium phthalocyanine crystal include a gallium phthalocyanine having a halogen atom, a hydroxy group, or an alkoxy group as an axial ligand at a gallium atom in the molecule thereof. A gallium phthalocyanine having a substituent such as a halogen atom in its phthalocyanine ring is also included.

In addition, the gallium phthalocyanine crystal is preferably a gallium phthalocyanine crystal in which N,N-dimethylformamide is further contained.

Of such gallium phthalocyanine crystals, hydroxygallium phthalocyanine crystals (which have a hydroxy group as an axial ligand at a gallium atom in the molecule thereof), bromogallium phthalocyanine crystals (which have a bromine atom as an axial ligand at a gallium atom in the molecule thereof), or iodogallium phthalocyanine crystals (which have an iodine atom as an axial ligand at a gallium atom in the molecule thereof) each having excellent sensitivity are preferred because the present invention effectively acts. Of those, hydroxygallium phthalocyanine crystals are particularly preferred.

Further, of such hydroxygallium phthalocyanine crystals, a hydroxygallium phthalocyanine crystal having peaks at Bragg angles $2\theta$ of $7.4° \pm 0.3°$ and $28.3° \pm 0.3°$ in CuKα X-ray diffraction is more preferred in terms of high image quality.

In addition, the gallium phthalocyanine crystal in which the amine compound represented by the formula (1) is contained is particularly preferred in terms of dispersibility.

The gallium phthalocyanine crystal in which the amine compound represented by the formula (1) is contained means that the amine compound represented by the formula (1) is incorporated into the crystal.

A production method for the gallium phthalocyanine crystal in which the amine compound represented by the formula (1) is contained is described.

The gallium phthalocyanine crystal in which the amine compound represented by the formula (1) is contained is obtained through the step of subjecting a gallium phthalocyanine obtained by an acid pasting method and the amine compound represented by the formula (1), which are mixed in a solvent, to wet milling treatment to perform crystal transformation.

The milling treatment to be performed here is, for example, a treatment to be performed with a milling apparatus such as a sand mill or a ball mill together with a dispersant such as a glass bead, a steel bead, or an alumina ball. A milling time is preferably about 10 to 60 hours. A particularly preferred method is as described below. The sample is taken every 5 to 10 hours and the Bragg angle of the crystal is identified. The amount of the dispersant to be used in the milling treatment is preferably 10 to 50 times as large as that of the gallium phthalocyanine on a mass basis. In addition, examples of the solvent to be used include: an amide-based solvent such as N,N-dimethylformamide, N,N-dimethylacetamide, N-methylformamide, N-methylacetamide, or N-methylpropionamido; a halogen-based solvent such as chloroform; an ether-based solvent such as tetrahydrofuran; and a sulfoxide-based solvent such as dimethyl sulfoxide. The usage of the solvent is preferably 5 to 30 times as large as that of the gallium phthalocyanine on a mass basis. The usage of the amine compound represented by the formula (1) is preferably 0.1 to 10 times as large as that of the gallium phthalocyanine on a mass basis.

In the present invention, whether the gallium phthalocyanine crystal of the present invention contains or not in itself the amine compound represented by the formula (1) was determined by analyzing data on the NMR measurement and thermogravimetric (TG) measurement of the resultant gallium phthalocyanine crystal.

For example, in the case where the milling treatment or a washing step after the milling is performed with a solvent capable of dissolving the amine compound represented by the formula (1), the resultant gallium phthalocyanine crystal is subjected to NMR measurement. Then, when the amine compound represented by the formula (1) is detected from the resultant gallium phthalocyanine crystal, it can be judged that the amine compound represented by the formula (1) is contained in the crystal.

On the other hand, in the case where the amine compound represented by the formula (1) is insoluble in the solvent used in the milling treatment and is also insoluble in the solvent for the washing after the milling, when the resultant gallium phthalocyanine crystal was subjected to NMR measurement and the amine compound represented by the formula (1) was detected, a judgment was made by the following method.

The gallium phthalocyanine crystal obtained by adding the amine compound represented by the formula (1), a gallium phthalocyanine crystal prepared in the same manner except for not adding the amine compound represented by the formula (1), and the amine compound represented by the formula (1) alone are separately subjected to TG measurement. When the result of the TG measurement of the gallium phthalocyanine crystal obtained by adding the amine compound can be interpreted as one obtained by merely mixing the separately measured results of the gallium phthalocyanine crystal obtained without adding the amine compound and the amine compound at a predetermined ratio, the gallium phthalocyanine crystal can be interpreted as being a mixture with the amine compound, or as merely having the amine compound adhering to its surface.

On the other hand, when the result of the TG measurement of the gallium phthalocyanine crystal obtained by adding the amine compound shows a weight reduction occurring at a higher temperature than that in the case of the result of the TG measurement of the amine compound alone, it can be judged that the amine compound represented by the formula (1) is contained in the gallium phthalocyanine crystal.

The TG measurement, X-ray diffraction measurement, and NMR measurement of the gallium phthalocyanine crystal to be contained in the electrophotographic photosensitive member of the present invention were performed under the following conditions.

(TG Measurement)

Used measuring apparatus: TG/DTA simultaneous measurement apparatus (trade name: TG/DTA220U) manufactured by Seiko Instruments Inc.

Atmosphere: under nitrogen flow (300 $cm^3$/min)

Measurement range: 35° C. to 600° C.

Temperature increasing rate: 10° C./min (Powder X-Ray Diffraction Measurement)

Used measuring apparatus: X-ray diffractometer RINT-TTRII manufactured by Rigaku Corporation X-ray tube bulb: Cu Tube voltage: 50 KV Tube current: 300 mA Scanning method: 2θ/θ scan Scanning rate: 4.0°/min Sampling interval: 0.02°

Start angle (2θ): 5.0°

Stop angle (2θ): 40.0°

Attachment: standard sample holder

Filter: not used

Incident monochromator: used

Counter monochromator: not used

Divergence slit: open

Divergence longitudinal restriction slit: 10.00 mm

Scattering slit: open

Light-receiving slit: open

Flat monochromator: used

Counter: scintillation counter (NMR Measurement)

Used measuring apparatus: AVANCE III 500 manufactured by BRUKER

Solvent: deuterated sulfuric acid ($D_2SO_4$)

The charge-generating layer on the support of the electrophotographic photosensitive member of the present invention contains the amine compound represented by the formula (1), the gallium phthalocyanine crystal, and the compound represented by the formula (2) or the formula (3) (arene compound). Alternatively, the charge-generating layer contains the gallium phthalocyanine crystal containing the amine compound represented by the formula (1), and the compound represented by the formula (2) or the formula (3). In addition, although any of the charge-generating layer and the charge-transporting layer may be the upper layer in their stacked relationship, it is more preferred that the charge-generating layer be the lower layer.

The support to be used in the present invention is preferably a support having conductivity (conductive support), and examples thereof include: metals and alloys such as aluminum and stainless steel; or metals, alloys, plastics, and papers each having formed thereon a conductive layer. The shape of the support is, for example, a cylindrical shape or a film shape.

In the present invention, an intermediate layer having a barrier function and an adhesion function (sometimes referred to as "undercoat layer") may be provided between the support and the charge-generating layer. As the material for the intermediate layer, there may be used polyvinyl alcohol, polyethylene oxide, ethyl cellulose, methyl cellulose, casein, polyamide, glue, gelatin, and the like. Such material is dissolved in a proper solvent and then applied onto the support. The thickness of the intermediate layer is preferably 0.3 to 5.0 μm.

Further, it is suitable to form a conductive layer between the support and the intermediate layer, for the purposes of covering irregularities or defects of the support and preventing an interference fringe. The conductive layer can be formed by dispersing conductive particles such as carbon black, metal particles, and metal oxides in a binder resin.

The thickness of the conductive layer is preferably 5 to 40 μm, particularly preferably 10 to 30 μm.

The charge-generating layer can be formed by: applying an application liquid for a charge-generating layer prepared by dispersing the amine compound represented by the formula (1), the gallium phthalocyanine crystal, and the compound represented by the formula (2) or the formula (3) (arene compound) in a solvent together with a binder resin; and drying the resultant applied film. Alternatively, the charge-generating layer can be formed by: applying an application liquid for a charge-generating layer prepared by dispersing the gallium phthalocyanine crystal containing the amine compound represented by the formula (1) and the compound represented by the formula (2) or the formula (3) in a solvent together with a binder resin; and drying the resultant applied film.

The thickness of the charge-generating layer is preferably 0.05 to 1 μm, more preferably 0.1 to 0.3 μm.

The content of the amine compound represented by the formula (1) in the charge-generating layer is preferably 0.03 mass % or more and 15 mass % or less, more preferably 0.05 mass % or more and 10 mass % or less with respect to the total mass of the charge-generating layer. In addition, the content of the amine compound represented by the formula (1) in the charge-generating layer is 0.05 mass % or more and 20 mass % or less with respect to a charge-generating substance. The amine compound to be contained in the charge-generating layer may be non-crystalline or crystalline. In addition, two or more kinds of the amine compounds can be used in combination. In addition, the gallium phthalocyanine crystal in which the amine compound represented by the formula (1) is contained in the charge-generating layer preferably contains the amine compound represented by the formula (1) at 0.05 mass % or more and 20 mass % or less with respect to the gallium phthalocyanine crystal.

In addition, the content of the arene compound (compound represented by the formula (2) or the formula (3)) in the charge-generating layer is preferably 0.15 mass % or more and 10 mass % or less, more preferably 0.3 mass % or more and 7 mass % or less with respect to the total mass of the charge-generating layer. In addition, the content of the arene compound (compound represented by the formula (2) or the formula (3)) in the charge-generating layer is 0.3 mass % or more and 10 mass % or less, preferably 0.3 mass % or more and 5 mass % or less with respect to the charge-generating substance.

In addition, the content of the gallium phthalocyanine crystal in the charge-generating layer is preferably 30 mass % or more and 90 mass % or less, more preferably 50 mass % or more and 80 mass % or less with respect to the total mass of the charge-generating layer.

The azo compound to be contained in the charge-generating layer may be non-crystalline or crystalline. In addition, two or more kinds of the azo compounds can be used in combination.

Examples of the binder resin to be used for the charge-generating layer include resins such as polyester, an acrylic resin, a phenoxy resin, polycarbonate, polyvinyl butyral, polystyrene, polyvinyl acetate, polysulfone, polyarylate, vinylidene chloride, an acrylonitrile copolymer, and polyvinyl benzal. Of those, polyvinyl butyral or polyvinyl benzal is preferred as the resin for dispersing the amine compound.

The charge-transporting layer may be formed mainly by: applying an application liquid for a charge-transporting layer prepared by dissolving a charge-transporting substance and a binder resin in a solvent; and drying the resultant applied film.

The thickness of the charge-transporting layer is preferably 5 to 40 μm, particularly preferably 10 to 25 μm.

The content of the charge-transporting substance is preferably 20 to 80 mass %, particularly preferably 30 to 60 mass % with respect to the total mass of the charge-transporting layer.

Examples of the charge-transporting substance include various triarylamine compounds, hydrazone compounds, stilbene compounds, pyrazoline compounds, oxazole compounds, thiazole compounds, and triarylmethane compounds. Of those, a triarylamine compound is preferred as the charge-transporting substance.

Examples of the binder resin to be used for the charge-transporting layer include resins such as polyester, an acrylic resin, a phenoxy resin, polycarbonate, polystyrene, polyvinyl acetate, polysulfone, polyarylate, vinylidene chloride, and an acrylonitrile copolymer. Of those, polycarbonate or polyarylate is preferred.

An application method such as an immersion coating method (dipping method), a spray coating method, a spinner coating method, a bead coating method, a blade coating method, or a beam coating method can be used as a method of applying each layer.

A protective layer may be formed on the photosensitive layer (charge-transporting layer) for protecting the photosensitive layer. The protective layer can be formed by: forming an applied film of an application liquid for the protective layer, which is obtained by dissolving a binder resin in an organic solvent, onto the photosensitive layer; and drying the resultant applied film.

Examples of the binder resin to be used for the protective layer include polyvinyl butyral, polyester, polycarbonate (e.g., polycarbonate Z or modified polycarbonate), nylon, polyimide, polyarylate, polyurethane, a styrene-butadiene copolymer, a styrene-acrylic acid copolymer, and a styrene-acrylonitrile copolymer. Alternatively, the protective layer can be formed by: forming an applied film of an application liquid for the protective layer; and curing the applied film with heat, an electron beam, UV light, or the like. The thickness of the protective layer is preferably 0.05 to 20 μm.

In addition, a conductive particle, a UV absorber, a lubricant particle such as a fluorine atom-containing resin fine particle, or the like may be incorporated into the protective layer. Preferred examples of the conductive particle include metal oxide particles such as a tin oxide particle.

FIG. 1 is a view illustrating an example of the schematic configuration of an electrophotographic apparatus including a process cartridge having the electrophotographic photosensitive member of the present invention.

A cylindrical (drum-shaped) electrophotographic photosensitive member 1 is rotationally driven about an axis 2 in a direction indicated by an arrow at a predetermined peripheral speed (process speed).

The surface of the electrophotographic photosensitive member 1 is charged to a predetermined positive or negative electric potential by a charging device 3 during the rotation process. Next, the charged surface of the electrophotographic photosensitive member 1 is irradiated with image exposure light 4 from an image exposing device (not shown) and then an electrostatic latent image corresponding to target image information is formed. The image exposure light 4 is, for example, light to be output from the image exposing device such as a slit exposure or a laser beam scanning exposure, the light having intensity modulated in correspondence with a time-series electrical digital image signal of the target image information.

The electrostatic latent image formed on the surface of the electrophotographic photosensitive member 1 is developed (subjected to normal development or reversal development) with toner stored in a developing device 5. Thus, a toner image is formed on the surface of the electrophotographic photosensitive member 1. The toner image formed on the surface of the electrophotographic photosensitive member 1 is transferred onto a transfer material 7 by a transferring device 6. At this time, a bias voltage opposite in polarity to the charge which the toner possesses is applied from a bias power source (not shown) to the transferring device 6. In addition, when the transfer material 7 is paper, the transfer material 7 is taken out from a sheet-feeding portion (not shown), and is then fed into a gap between the electrophotographic photosensitive member 1 and the transferring device 6 in synchronization with the rotation of the electrophotographic photosensitive member 1.

The transfer material 7 onto which the toner image has been transferred from the electrophotographic photosensitive member 1 is separated from the surface of the electrophotographic photosensitive member 1 and then conveyed to an image fixing device 8 where the transfer material is subjected to a treatment for fixing the toner image. Thus, the transfer material is printed out as an image-formed product (print or copy) to the outside of the electrophotographic apparatus.

The surface of the electrophotographic photosensitive member 1 after the transfer of the toner image onto the transfer material 7 is subjected to the removal of attached matters thereon such as the toner (transfer residual toner) by a cleaning device 9, thereby being cleaned. A cleaner-less system has been developed in recent years and hence the transfer residual toner can be directly removed with a developing device or the like. Further, the surface of the electrophotographic photosensitive member 1 is subjected to an antistatic treatment by pre-exposure light 10 from pre-exposing device (not shown) before being repeatedly used for image formation. It should be noted that when the charging device 3 is a contact charging device using a charging roller or the like, the pre-exposing device is not necessarily needed.

In the present invention, the following procedure can be adopted. Multiple components out of the components such as the electrophotographic photosensitive member 1, the charging device 3, the developing device 5, and the cleaning device 9 can be stored in a container and integrally supported to form a process cartridge. The process cartridge can be detachably mountable to the main body of the electrophotographic apparatus. For example, the following procedure can be adopted. At least one selected from the charging device 3, the developing device 5, and the cleaning device 9 is integrally supported with the electrophotographic photosensitive member 1 to form a cartridge. Then, the cartridge is used as a process cartridge 11 detachably mountable to the main body of the electrophotographic apparatus with a guiding device 12 such as a rail of the main body of the electrophotographic apparatus.

When the electrophotographic apparatus is a copying machine or a printer, the image exposure light 4 may be transmitted light or reflected light from a manuscript. Alternatively, the light may be light radiated by, for example, scanning a laser beam, driving an LED array, or driving a liquid crystal shutter array to be performed in accordance with a signal turned from the manuscript read with a sensor.

The electrophotographic photosensitive member 1 of the present invention is also widely applicable to the fields of application of electrophotography such as a laser beam printer, a CRT printer, an LED printer, a FAX, a liquid crystal printer, and laser plate making.

EXAMPLES

Hereinafter, the present invention is described in more detail by way of specific examples. The term "part(s)" in the following description means "part(s) by mass." However, the present invention is not limited to these examples. It should be noted that the thickness of each layer of any one of the electrophotographic photosensitive members in Examples and Comparative Examples was determined with an eddy-current thickness meter (Fischerscope manufactured by Fischer Instruments), or was determined from its mass per unit area by specific gravity conversion.

Example 1-1

Figure 2:
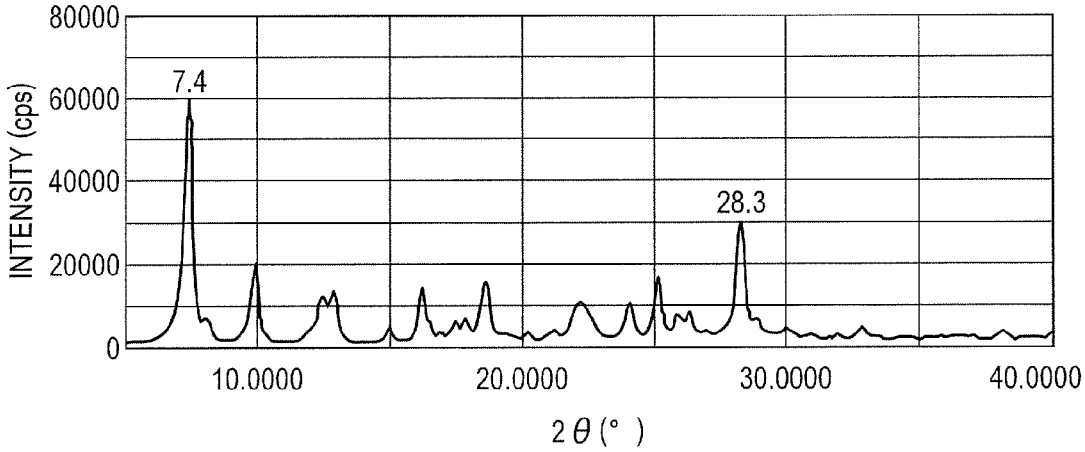
FIG. 2 is a powder X-ray diffraction pattern of a hydroxygallium phthalocyanine crystal obtained in Example 1-1.

Hydroxygallium phthalocyanine obtained by the same treatment as that of Example 1-1 subsequent to Synthesis Example 1 described in Japanese Patent Application Laid-Open No. 2011-94101 was prepared. 0.5 Part of the hydroxygallium phthalocyanine, 1.0 part of Exemplified Compound (1) (product code: 159400050, manufactured by Acros Organics), and 10 parts of N,N-dimethylformamide were subjected to a milling treatment in a ball mill together with 20 parts of glass beads each having a diameter of 0.8 mm at room temperature (23° C.) for 40 hours. A gallium phthalocyanine crystal was taken out from the dispersion with N,N-dimethylformamide, and filtered, and then the residue on the filter was sufficiently washed with tetrahydrofuran. The residue was vacuum-dried to yield 0.50 part of a hydroxygallium phthalocyanine crystal. FIG. 2 shows the powder X-ray diffraction pattern of the resultant crystal.

In addition, NMR measurement confirmed that the hydroxygallium phthalocyanine crystal obtained in Example 1-1 contained 0.31 mass % of Exemplified Compound (1) and 2.05 mass % of N,N-dimethylformamide, the values being calculated from proton ratios. Thus, it is found that Exemplified Compound (1) is contained in the crystal because Exemplified Compound (1) dissolves in N,N-dimethylformamide.

Example 1-2

Figure 3:
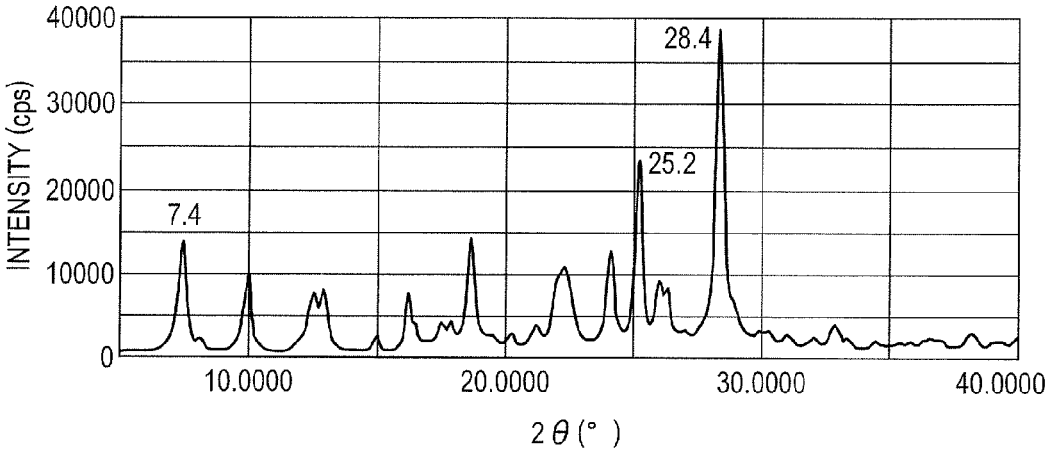
FIG. 3 is a powder X-ray diffraction pattern of a hydroxygallium phthalocyanine crystal obtained in Example 1-2.

0.46 Part of a hydroxygallium phthalocyanine crystal was obtained by the same treatment as that of Example 1-1 except that in Example 1-1, 1.0 part of Exemplified Compound (1) was changed to 0.5 part of Exemplified Compound (2) (product code: B0139, manufactured by Tokyo Chemical Industry Co., Ltd.) and the milling treatment time was changed from 40 hours to 55 hours. FIG. 3 shows the powder X-ray diffraction pattern of the resultant crystal.

In addition, NMR measurement confirmed that the hydroxygallium phthalocyanine crystal obtained in Example 1-2 contained 0.16 mass % of Exemplified Compound (2) and 1.88 mass % of N,N-dimethylformamide, the values being calculated from proton ratios. Thus, it is found that Exemplified Compound (2) is contained in the crystal because Exemplified Compound (2) dissolves in N,N-dimethylformamide.

Example 1-3

0.40 Part of a hydroxygallium phthalocyanine crystal was obtained by the same treatment as that of Example 1-1 except that in Example 1-1, Exemplified Compound (1) was not added. The powder X-ray diffraction pattern of the resultant hydroxygallium phthalocyanine crystal was similar to that of FIG. 2.

In addition, NMR measurement confirmed that the hydroxygallium phthalocyanine crystal obtained in Example 1-3 contained 1.93 mass % of N,N-dimethylformamide, the value being calculated from proton ratios.

Example 2-1

A solution formed of 60 parts of barium sulfate particles coated with tin oxide (trade name: Passtran PC1, manufactured by MITSUI MINING & SMELTING CO., LTD.), 15 parts of titanium oxide particles (trade name: TITANIX JR, manufactured by TAYCA CORPORATION), 43 parts of a resole-type phenol resin (trade name: Phenolite J-325, manufactured by DIC Corporation, solid content: 70 mass %), 0.015 part of a silicone oil (trade name: SH28PA, manufactured by Dow Corning Toray Co., Ltd.), 3.6 parts of a silicone resin (trade name: Tospearl 120, manufactured by Momentive Performance Materials Inc.), 50 parts of 2-methoxy-1-propanol, and 50 parts of methanol was subjected to a dispersion treatment in a ball mill for 20 hours. Thus, an application liquid for a conductive layer was prepared.

The application liquid for a conductive layer was applied onto an aluminum cylinder (having a diameter of 30 mm) as a support by dip coating and then the resultant applied film was dried for 30 minutes at 140° C. Thus, a conductive layer having a thickness of 15 μm was formed.

Next, 10 parts of a copolymer nylon resin (trade name: Amilan CM8000, manufactured by Toray Industries, Inc.) and 30 parts of a methoxymethylated 6-nylon resin (trade name: Toresin EF-30T, manufactured by Nagase ChemteX Corporation) were dissolved in a mixed solvent of 400 parts of methanol and 200 parts of n-butanol. Thus, an application liquid for an undercoat layer was prepared.

The application liquid for an undercoat layer was applied onto the conductive layer by dip coating and then the resultant applied film was dried. Thus, an undercoat layer having a thickness of 0.5 μm was formed.

Next, 11.5 parts of the hydroxygallium phthalocyanine crystal (charge-generating substance) obtained in Example 1-3, 0.3 part of Exemplified Compound (1), 0.1 part of Exemplified Compound (2-1), 3.5 parts of polyvinyl butyral (trade name: S-LEC BX-1, manufactured by SEKISUI CHEMICAL CO., LTD.), and 250 parts of cyclohexanone were loaded into a sand mill using glass beads each having a diameter of 1 mm, and were then subjected to a dispersion treatment for 6 hours. The resultant was diluted with 250 parts of ethyl acetate. Thus, an application liquid for a charge-generating layer was prepared.

The application liquid for a charge-generating layer was applied onto the undercoat layer by dip coating and then the resultant applied film was dried for 10 minutes at 100° C. Thus, a charge-generating layer having a thickness of 0.16 μm was formed.

Next, 8 parts of a compound (charge-transporting substance) represented by the following formula (103) and parts of polycarbonate (trade name: Iupilon Z-200, manufactured by MITSUBISHI GAS CHEMICAL COMPANY, INC.) were dissolved in 70 parts of monochlorobenzene. Thus, an application liquid for a charge-transporting layer was prepared.

(103)

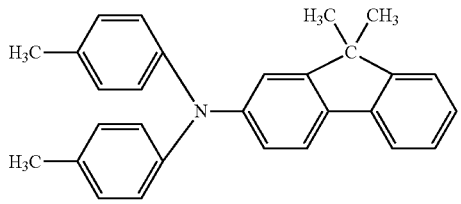

The application liquid for a charge-transporting layer was applied onto the charge-generating layer by dip coating and then the resultant applied film was dried for 1 hour at 110° C. Thus, a charge-transporting layer having a thickness of 23 μm was formed.

Thus, a cylindrical (drum-shaped) electrophotographic photosensitive member of Example 2-1 was produced.

Example 2-2

An electrophotographic photosensitive member of Example 2-2 was produced in the same manner as in Example 2-1 except that in Example 2-1, 0.3 part of Exemplified Compound (1) used in the preparation of the application liquid for a charge-generating layer was changed to 0.3 part of Exemplified Compound (2).

Example 2-3

An electrophotographic photosensitive member of Example 2-3 was produced in the same manner as in Example 2-1 except that in Example 2-1, 0.1 part of Exemplified Compound (2-1) used in the preparation of the application liquid for a charge-generating layer was changed to 0.1 part of Exemplified Compound (2-4).

Example 2-4

An electrophotographic photosensitive member of Example 2-4 was produced in the same manner as in Example 2-3 except that in Example 2-3: 11.5 parts of the hydroxygallium phthalocyanine crystal (charge-generating substance) obtained in Example 1-3 used in the preparation of the application liquid for a charge-generating layer were changed to 11.5 parts of the hydroxygallium phthalocyanine crystal (charge-generating substance) obtained in Example 1-1; and 0.3 part of Exemplified Compound (2) was not added.

Example 2-5

An electrophotographic photosensitive member of Example 2-5 was produced in the same manner as in Example 2-1 except that in Example 2-1: 11.5 parts of the hydroxygallium phthalocyanine crystal (charge-generating substance) obtained in Example 1-3 used in the preparation of the application liquid for a charge-generating layer were changed to 11.5 parts of the hydroxygallium phthalocyanine crystal (charge-generating substance) obtained in Example 1-2; and 0.3 part of Exemplified Compound (1) was not added.

Example 2-6

An electrophotographic photosensitive member of Example 2-6 was produced in the same manner as in Example 2-1 except that in Example 2-1, 0.1 part of Exemplified Compound (2-1) used in the preparation of the application liquid for a charge-generating layer was changed to 0.1 part of Exemplified Compound (3-1).

Example 2-7

An electrophotographic photosensitive member of Example 2-7 was produced in the same manner as in Example 2-6 except that in Example 2-6, 0.3 part of Exemplified Compound (1) used in the preparation of the application liquid for a charge-generating layer was changed to 0.3 part of Exemplified Compound (2).

Example 2-8

An electrophotographic photosensitive member of Example 2-8 was produced in the same manner as in Example 2-7 except that in Example 2-7, 0.1 part of Exemplified Compound (3-1) used in the preparation of the application liquid for a charge-generating layer was changed to 0.1 part of Exemplified Compound (3-19).

Example 2-9

An electrophotographic photosensitive member of Example 2-9 was produced in the same manner as in Example 2-8 except that in Example 2-8: 11.5 parts of the hydroxygallium phthalocyanine crystal (charge-generating substance) obtained in Example 1-3 used in the preparation of the application liquid for a charge-generating layer were changed to 11.5 parts of the hydroxygallium phthalocyanine crystal (charge-generating substance) obtained in Example 1-1; and 0.3 part of Exemplified Compound (2) was not added.

Example 2-10

An electrophotographic photosensitive member of Example 2-10 was produced in the same manner as in Example 2-6 except that in Example 2-6: 11.5 parts of the hydroxygallium phthalocyanine crystal (charge-generating substance) obtained in Example 1-3 used in the preparation of the application liquid for a charge-generating layer were changed to 11.5 parts of the hydroxygallium phthalocyanine crystal (charge-generating substance) obtained in Example 1-2; and 0.3 part of Exemplified Compound (1) was not added.

Comparative Example 2-1

An electrophotographic photosensitive member of Comparative Example 2-1 was produced in the same manner as in Example 2-1 except that in Example 2-1, 0.3 part of Exemplified Compound (1) and 0.1 part of Exemplified Compound (2-1) used in the preparation of the application liquid for a charge-generating layer were not added.

Comparative Example 2-2

An electrophotographic photosensitive member of Comparative Example 2-2 was produced in the same manner as in Example 2-1 except that in Example 2-1, 0.1 part of Exemplified Compound (2-1) used in the preparation of the application liquid for a charge-generating layer was not added.

Comparative Example 2-3

An electrophotographic photosensitive member of Comparative Example 2-3 was produced in the same manner as in Example 2-2 except that in Example 2-2, 0.1 part of Exemplified Compound (2-1) used in the preparation of the application liquid for a charge-generating layer was not added.

Comparative Example 2-4

An electrophotographic photosensitive member of Comparative Example 2-4 was produced in the same manner as in Example 2-6 except that in Example 2-6, 0.3 part of Exemplified Compound (1) used in the preparation of the application liquid for a charge-generating layer was not added.

Evaluations of Examples 2-1 to 2-10 and Comparative Examples 2-1 to 2-4

The electrophotographic photosensitive members of Examples 2-1 to 2-10 and Comparative Examples 2-1 to 2-4 were subjected to an image evaluation.

The produced electrophotographic photosensitive members were left to stand under a high-temperature and high-humidity (temperature: 32.5° C./humidity: 80% RH) environment for 24 hours, and were then evaluated for output images under the same environment.

The evaluation for output images was performed with a laser beam printer manufactured by Hewlett-Packard Company (trade name: Color LaserJet 4600) reconstructed so as to have a dark portion potential of −800 V (process speed: 94.2 mm/s). The charging device of the laser beam printer is a contact charging device provided with a charging roller, and a voltage formed only of a DC voltage is applied to the charging roller. In addition, the laser beam printer is an electrophotographic apparatus that includes no antistatic device at a position upstream of the charging device and downstream of a transferring device in a direction of the rotation of the electrophotographic photosensitive member.

The produced electrophotographic photosensitive members were each mounted on a process cartridge for a cyan color of the laser beam printer, and the resultant was attached to a station for the process cartridge for a cyan color of the laser beam printer. Then, images for the evaluation were output.

First, as an image for a black spot and fogging evaluation, a solid white image was output. Next, as an image for a density unevenness evaluation, a halftone image whose dot density was set to 1 dot/1 space was output. The evaluation was performed by visually observing the presence or absence of a defect on the output image.

The black spot and fogging evaluation was performed according to the following criteria.

A: No minute black dot is observed.

B: An extremely small amount of minute black dots (one to five sites) is recognized.

C: Minute black dots are locally recognized at several sites (six or more sites).

D: Minute black dots are observed on the entire surface.

For each of the ranks C and D out of those ranks, it was judged that the effect of the present invention was not sufficiently obtained.

In addition, as for the density unevenness evaluation, a sensory test was performed.

TABLE 3

| | Black spot and fogging evaluation | Density unevenness evaluation |
|---|---|---|
| Example 2-1 | B | Satisfactory |
| Example 2-2 | B | Satisfactory |
| Example 2-3 | B | Satisfactory |
| Example 2-4 | A | Satisfactory |
| Example 2-5 | A | Satisfactory |
| Example 2-6 | B | Satisfactory |
| Example 2-7 | B | Satisfactory |
| Example 2-8 | B | Satisfactory |
| Example 2-9 | A | Satisfactory |
| Example 2-10 | A | Satisfactory |
| Comparative Example 2-1 | D | Having density unevenness |
| Comparative Example 2-2 | D | Having density unevenness |
| Comparative Example 2-3 | D | Having density unevenness |
| Comparative Example 2-4 | C | Satisfactory |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-273721, filed Dec. 14, 2012, which is hereby incorporated by reference herein in its entirety.

What is claimed is:

1. An electrophotographic photosensitive member comprising:

a support;

a charge-generating layer; and a charge-transporting layer, the charge-generating layer and the charge-transporting layer being formed on the support, wherein the charge-generating layer comprises:

a gallium phthalocyanine crystal in which N,N-dimethylformamide is contained;

an amine compound represented by the following formula (1) at 0.05 mass % or more and 20 mass % or less with respect to the gallium phthalocyanine crystal; and an arene compound at 0.3 mass % or more and 5 mass % or less with respect to the gallium phthalocyanine crystal, the arene compound being at least one compound selected from the group consisting of a compound represented by the following formula (2) and a compound represented by the following formula (3):

Formula (1)

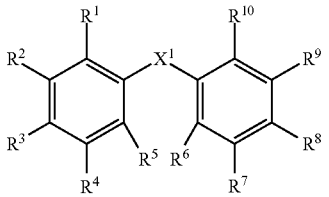

wherein $R^1$ to $R^{10}$ each independently represent a hydrogen atom, a halogen atom, an aryloxycarbonyl group, a substituted or unsubstituted acyl group, a substituted or unsubstituted alkyl group, a substituted or unsubstituted alkoxy group, a substituted or unsubstituted aryloxy group, an amino group having a substituent, or a substituted or unsubstituted cyclic amino group, provided that at least one of $R^1$ to $R^{10}$ represents an amino group substituted with a substituted or unsubstituted aryl group, an amino group substituted with a substituted or unsubstituted alkyl group, or a substituted or unsubstituted cyclic amino group, and $X^1$ represents a carbonyl group or a dicarbonyl group;

Formula (2)

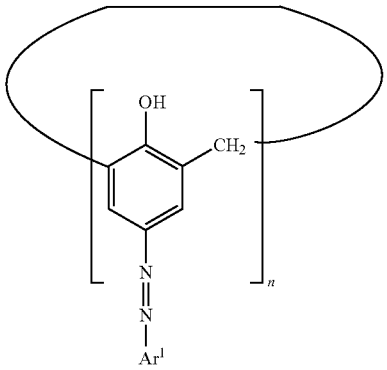

wherein n represents an integer selected from 4 to 8, and n units of $Ar^1$ are identical to each other, and represent an aromatic hydrocarbon ring group that may have a substituent, a hetero ring group that may have a substituent, or a group formed by a combination of multiple aromatic hydrocarbon ring groups or multiple hetero ring groups; and Formula (3)

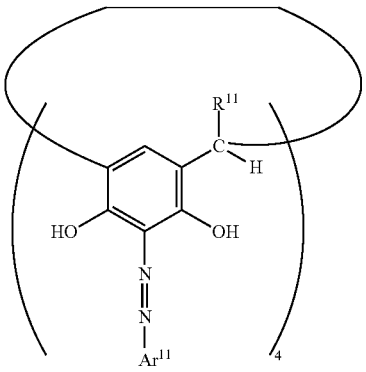

wherein four units of $R^{11}$ are identical to each other, and represent a hydrogen atom or an alkyl group that may have a substituent, and four units of $Ar^{11}$ are identical to each other, and represent an aromatic hydrocarbon ring group that may have a substituent, a hetero ring group that may have a substituent, or a group formed by a combination of multiple aromatic hydrocarbon ring groups or multiple hetero ring groups.

2. The electrophotographic photosensitive member according to claim 1, wherein the gallium phthalocyanine crystal is a gallium phthalocyanine crystal in which the amine compound represented by the formula (1) is contained at 0.05 mass % or more and 20 mass % or less with respect to the gallium phthalocyanine crystal.

3. The electrophotographic photosensitive member according to claim 1, wherein at least one of the $R^1$ to the $R^{10}$ represents an amino group substituted with a substituted or unsubstituted alkyl group.

4. The electrophotographic photosensitive member according to claim 3, wherein the substituted or unsubstituted alkyl group is an alkyl group substituted with an alkoxy group, an alkyl group substituted with an aryl group, or an unsubstituted alkyl group.

5. The electrophotographic photosensitive member according to claim 3, wherein the amino group substituted with the substituted or unsubstituted alkyl group is a dialkylamino group.

6. The electrophotographic photosensitive member according to claim 5, wherein the dialkylamino group is a dimethylamino group or a diethylamino group.

7. The electrophotographic photosensitive member according to claim 1, wherein at least one of the $R^1$ to the $R^{10}$ represents a substituted or unsubstituted cyclic amino group.

8. The electrophotographic photosensitive member according to claim 7, wherein the substituted or unsubstituted cyclic amino group is a morpholino group or a 1-piperidino group.

9. The electrophotographic photosensitive member according to claim 1, wherein the amine compound is 4,4'-bis(diethylamino)benzophenone.

10. The electrophotographic photosensitive member according to claim 1, wherein one of the $Ar^1$ and the $Ar^{11}$ represents a phenyl group having at least one group selected from the group consisting of a cyano group, a nitro group, and a halogen atom.

11. The electrophotographic photosensitive member according to claim 10, wherein one of the $Ar^1$ and the $Ar^{11}$ represents a phenyl group having one of a cyano group and a nitro group at a meta-position thereof.

12. The electrophotographic photosensitive member according to claim 1, wherein the gallium phthalocyanine crystal is a hydroxygallium phthalocyanine crystal.

13. The electrophotographic photosensitive member according to claim 12, wherein the hydroxygallium phthalocyanine crystal is a hydroxygallium phthalocyanine crystal having peaks at Bragg angles 2θ of 7.4°±0.3° and 28.3°±0.3° in CuKα X-ray diffraction.

14. A process cartridge detachably mountable to a main body of an electrophotographic apparatus, wherein the process cartridge integrally supports:

an electrophotographic photosensitive member a; and at least one device selected from the group consisting of a charging device for charging a surface of the electrophotographic photosensitive member, a developing device for developing an electrostatic latent image formed on the surface of the electrophotographic photosensitive member with toner to form a toner image, and a cleaning device for removing the toner on the surface of the electrophotographic photosensitive member after transfer of the toner image onto a transfer material, wherein the electrophotographic photosensitive member comprises:

a support;

a charge-generating layer; and a charge-transporting layer, the charge-generating layer and the charge-transporting layer being formed on the support, wherein the charge-generating layer comprises:

a gallium phthalocyanine crystal in which N,N-dimethylformamide is contained;

an amine compound represented by the following formula (1) at 0.05 mass % or more and 20 mass % or less with respect to the gallium phthalocyanine crystal; and an arene compound at 0.3 mass % or more and 5 mass % or less with respect to the gallium phthalocyanine crystal, the arene compound being at least one compound selected from the group consisting of a compound represented by the following formula (2) and a compound represented by the following formula (3):

Formula (1)

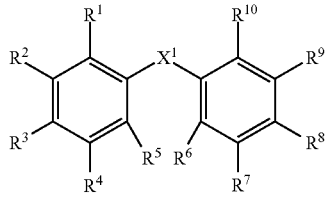

wherein $R^1$ to $R^{10}$ each independently represent a hydrogen atom, a halogen atom, an aryloxycarbonyl group, a substituted or unsubstituted acyl group, a substituted or unsubstituted alkyl group, a substituted or unsubstituted alkoxy group, a substituted or unsubstituted aryloxy group, an amino group having a substituent, or a substituted or unsubstituted cyclic amino group, provided that at least one of $R^1$ to $R^{10}$ represents an amino group substituted with a substituted or unsubstituted aryl group, an amino group substituted with a substituted or unsubstituted alkyl group, or a substituted or unsubstituted cyclic amino group, and $X^1$ represents a carbonyl group or a dicarbonyl group;

Formula (2)

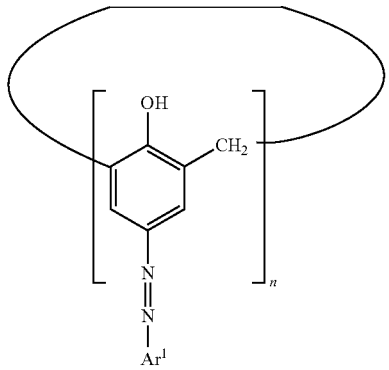

wherein n represents an integer selected from 4 to 8, and n units of $Ar^1$ are identical to each other, and represent an aromatic hydrocarbon ring group that may have a substituent, a hetero ring group that may have a substituent, or a group formed by a combination of multiple aromatic hydrocarbon ring groups or multiple hetero ring groups; and Formula (3)

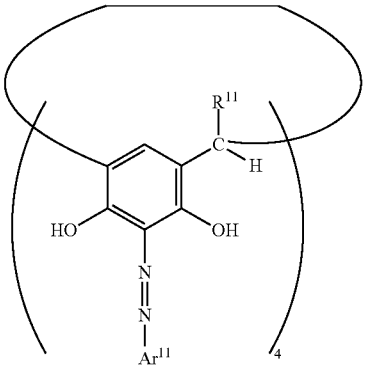

wherein four units of $R^{11}$ are identical to each other, and represent a hydrogen atom or an alkyl group that may have a substituent, and four units of $Ar^{11}$ are identical to each other, and represent an aromatic hydrocarbon ring group that may have a substituent, a hetero ring group that may have a substituent, or a group formed by a combination of multiple aromatic hydrocarbon ring groups or multiple hetero ring groups.

15. An electrophotographic apparatus comprising:

an electrophotographic photosensitive member;

a charging device for charging a surface of the electrophotographic photosensitive member;

an image exposing device for irradiating the charged surface of the electrophotographic photosensitive member with image exposure light to form an electrostatic latent image;

a developing device for developing the electrostatic latent image formed on the surface of the electrophotographic photosensitive member with toner to form a toner image; and a transferring device for transferring the toner image formed on the surface of the electrophotographic photosensitive member onto a transfer material, wherein the electrophotographic photosensitive member comprises:

a support;

a charge-generating layer; and a charge-transporting layer, the charge-generating layer and the charge-transporting layer being formed on the support, wherein the charge-generating layer comprises:

a gallium phthalocyanine crystal in which N,N-dimethylformamide is contained;

an amine compound represented by the following formula (1) at 0.05 mass % or more and 20 mass % or less with respect to the gallium phthalocyanine crystal; and an arene compound at 0.3 mass % or more and 5 mass % or less with respect to the gallium phthalocyanine crystal, the arene compound being at least one compound selected from the group consisting of a compound represented by the following formula (2) and a compound represented by the following formula (3):

Formula (1)

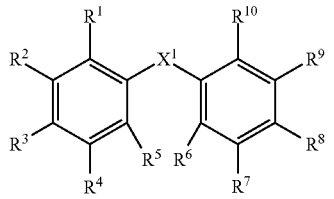

wherein $R^1$ to $R^{10}$ each independently represent a hydrogen atom, a halogen atom, an aryloxycarbonyl group, a substituted or unsubstituted acyl group, a substituted or unsubstituted alkyl group, a substituted or unsubstituted alkoxy group, a substituted or unsubstituted aryloxy group, an amino group having a substituent, or a substituted or unsubstituted cyclic amino group, provided that at least one of $R^1$ to $R^{10}$ represents an amino group substituted with a substituted or unsubstituted aryl group, an amino group substituted with a substituted or unsubstituted alkyl group, or a substituted or unsubstituted cyclic amino group, and $X^1$ represents a carbonyl group or a dicarbonyl group;

Formula (2)

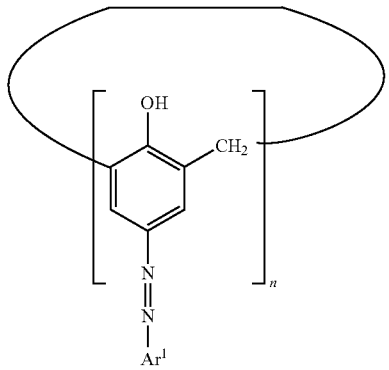

wherein n represents an integer selected from 4 to 8, and n units of $Ar^1$ are identical to each other, and represent an aromatic hydrocarbon ring group that may have a substituent, a hetero ring group that may have a substituent, or a group formed by a combination of multiple aromatic hydrocarbon ring groups or multiple hetero ring groups; and Formula (3)

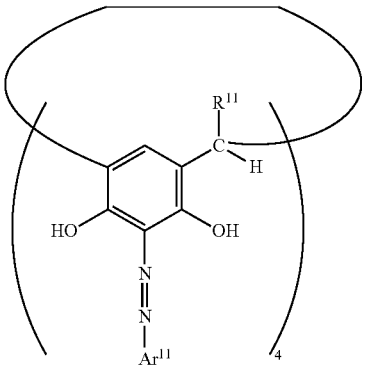

wherein four units of $R^{11}$ are identical to each other, and represent a hydrogen atom or an alkyl group that may have a substituent, and four units of $Ar^{11}$ are identical to each other, and represent an aromatic hydrocarbon ring group that may have a substituent, a hetero ring group that may have a substituent, or a group formed by a combination of multiple aromatic hydrocarbon ring groups or multiple hetero ring groups.

* * * * *